US006308561B1

(12) United States Patent
Samworth et al.

(10) Patent No.: US 6,308,561 B1
(45) Date of Patent: Oct. 30, 2001

(54) WELL LOGGING APPARATUS

(75) Inventors: James Roger Samworth, Ashby de la Zouch; Charles Richard Easter; Charles Alexander Pereira, both of Loughborough; Terence Paul Mayor, Keyworth, all of (GB)

(73) Assignee: Reeves Wireline Technologies (GB)

( * ) Notice: Subject to any disclaimer, the term of this patent is extended or adjusted under 35 U.S.C. 154(b) by 0 days.

(21) Appl. No.: 09/337,146

(22) Filed: Jun. 21, 1999

(30) Foreign Application Priority Data

Jun. 26, 1998 (GB) ..... 9813735

(51) Int. Cl.[7] ..... G01V 5/12; G01V 5/00; G06F 15/20

(52) U.S. Cl. ..... 73/152.02; 73/152.14; 250/269.7; 250/268

(58) Field of Search ..... 73/152.02, 152.14, 73/152.46; 250/268, 269.7

(56) References Cited

U.S. PATENT DOCUMENTS

| | | | | |
|---|---|---|---|---|
| 3,577,783 | * | 5/1971 | Whitten | 73/152 |
| 3,654,470 | | 4/1972 | Wilson | 250/83.6 W |
| 3,798,966 | * | 3/1974 | Planche | 73/151 |
| 3,946,604 | * | 3/1976 | Anderson | 73/152 |
| 4,031,750 | * | 6/1977 | Youmans | 73/151 |
| 4,034,218 | | 7/1977 | Turcotte | 250/269 |
| 4,048,495 | | 9/1977 | Ellis | 250/264 |
| 4,504,736 | | 3/1985 | Smith, Jr. et al. | 250/256 |
| 4,578,580 | | 3/1986 | Smith, Jr. | 250/269 |
| 4,628,202 | | 12/1986 | Minette | 250/269 |
| 4,661,700 | | 4/1987 | Holenka | 250/267 |
| 4,814,611 | | 3/1989 | Moake | 250/267 |
| 4,929,915 | * | 5/1990 | Wittrisch | 324/347 |
| 5,134,285 | | 7/1992 | Perry et al. | 250/269 |
| 5,204,529 | | 4/1993 | Diatschenko | 250/268 |
| 5,390,115 | | 2/1995 | Case et al. | 364/422 |
| 5,451,779 | | 9/1995 | Spross et al. | 250/266 |
| 5,528,029 | | 6/1996 | Chapellat et al. | 250/266 |
| 5,528,556 | * | 6/1996 | Seeman | 367/25 |
| 5,530,243 | | 6/1996 | Mathis | 250/269.3 |
| 5,563,512 | * | 10/1996 | Mumby | 324/339 |
| 5,596,142 | | 1/1997 | Delpuech et al. | 73/152.17 |
| 5,608,215 | | 3/1997 | Evans | 250/269.6 |

* cited by examiner

*Primary Examiner*—Hezron Williams
*Assistant Examiner*—David J. Wiggins
(74) *Attorney, Agent, or Firm*—Paul & Paul

(57) ABSTRACT

A well logging device of compact reduced diameter compared to the prior art, such well logging device having both short spaced and long spaced types of gamma ray crystal detectors installed in a measurements skid that comprises a relatively small diameter device constructed to withstand high temperatures and pressures, this device comprising a continuous stainless steel tube which provides pressure resistance and also allows low energy gamma ray transparency via large and small windows. This elongate type of stainless steel skid tube is furthermore internally supported by an internal tungsten tube placed therewithin, while the skid design also includes means for pressing the skid tube against a borehole wall so as to obtain more accurate formation density measurements downhole.

13 Claims, 2 Drawing Sheets

WELL LOGGING APPARATUS

The present invention relates to well logging apparatus and more particularly to well logging apparatus which is able to be deployed in relatively narrow boreholes in order to measure formation density.

It is advantageous to be able to deploy a logging apparatus in a small diameter borehole for several reasons. In a number of boreholes the direction of the borehole changes to follow specific strata and if a large diameter apparatus is used this can often not follow the borehole. Also, if borehole conditions are difficult then often the drill pipe may be left in place, at leave over the difficult section. It is advantageous to be able to deploy a logging device by running it through the drill pipe into the "open" hole beyond.

To achieve high quality borehole density measurements it is know that the logging device must preferably have a number of advantageous features. To achieve all of these in a relatively small diameter device has hereto been very difficulty. The present invention seeks to provide these features in a small diameter device preferably less than 2¼" diameter as opposed to the normal 3¼" or greater diameter of a standard device.

The features preferably required for a "density logging device" are:

1. Two or more detectors for compensation/correction for mudcake;
2. Scintillation counter detector systems for good counting statistics and therefore good measurement precision;
3. Effective shielding using Tungsten or similar to reduce radiation into the borehole, and therefore the perturbing effect on measurement of varying borehole size and fluid content;
4. To get good quality measurements, the detector system needs to be carried in a short "pad" or "skid" pressed against the borehole wall and free to follow borehole irregularities. A relatively poor measurement results if the detector system is carried in the body of the instrument ("sonde") without any provision or mechanism for moving, tilting or pressing its detector array into contact with mudcake or borehole wall, i.e. if the device is the basic version of "mandrel" type that does not allow any lateral adjustment of its detector position.
5. A technique for measuring the "photoelectric factor" and hence indicating lithological rock types can be employed which involves measuring the energy of the detected gamma rays. The energy spectrum is split into low and high ("soft" and "hard") received energy sections and a ratio of these sections formed which is then related to the photoelectric factor.
6. To measure low energies the detector system casing needs to be transparent to these energies.
7. To access difficult borehole conditions it is advantageous to maintain as small a diameter sonde as possible.
8. The detector skid needs to be disposed in "carrier" which is "through wired" to enable other devices to be connected below it, forming a sonde "stack".
9. The employment of a "free to move" skid requires a flexible cable and sealed connector system prone to unreliability.

In prior art devices the transparent casing of 6. is realized by puncturing the casing and employing a window of Beryllium, Titanium, or other light material, welded, bonded, or otherwise sealed into the window aperture.

Features 3, 4, 6, 8 and 9 require sonde diameters of more than 3.5" and more typically 4" +. This limits the deployment in "slim" boreholes, and in particular the deployment of the device by running it through the drill pipe into the "pen"hole beyond.

Prior art systems are described in U.S. Pat. Nos. 3,654,470, 4,034,218, 4,048,495, 4,504,736, 4,578,580, 4,628,202, 4,661,700, 4,814,611, 5,134,285, 5,204,529, 5,390,115, 5,451,779, 5,528,029, 5,530,243, and 5,608,215 which may be referred to for explanation of well logging techniques in general.

It is an object of the present invention to provide a logging device capable of providing high quality measurements in a small diameter and the present invention provides a well logging device including a detector system having a long spaced detector and a short spaced detector mounted in a skid, said skid being provided with means for pressing said skid against the side of a borehole, said skid comprising an elongate tube of low energy gamma ray transparency, said tube being internally supported by an inner support means to provide support for said elongate tube over a major internal area of said elongate tube.

Preferably said elongate tube comprises a stainless steel tube.

Preferably said internal support means comprises an internal tungsten tube.

Preferably said internal tungsten tube is provided with a first relatively elongate window having length and width dimensions that are compatible with an adjacent said long spaced detector crystal.

Preferably said relatively elongate window is provided with a filler.

Preferably said internal support means is also provided with a shorter window, having length and width dimensions generally compatible with an adjacent said short spaced detector crystal.

Preferably said relatively elongate window is provided with a filler.

Preferably said internal support means is also provided with a shorter window, having length and width dimensions generally compatible with an adjacent said sort spaced detector crystal.

Preferably the shorter window is not provided with a filler but is provided with a liner to absorb X-rays from the tungsten tube. Preferably said liner is constructed from tin.

Preferably the pad is also provided with an electronics section adjacent to said reinforcing means but within the measurement skid tube.

Preferably the reinforcing means is sealed against the stainless steel tube by a plurality of 'O' ring seals adjacent to each end of the reinforcing means.

Embodiments of the present invention will now be described by way of example with reference to the accompanying drawings in which.

Figure 1:
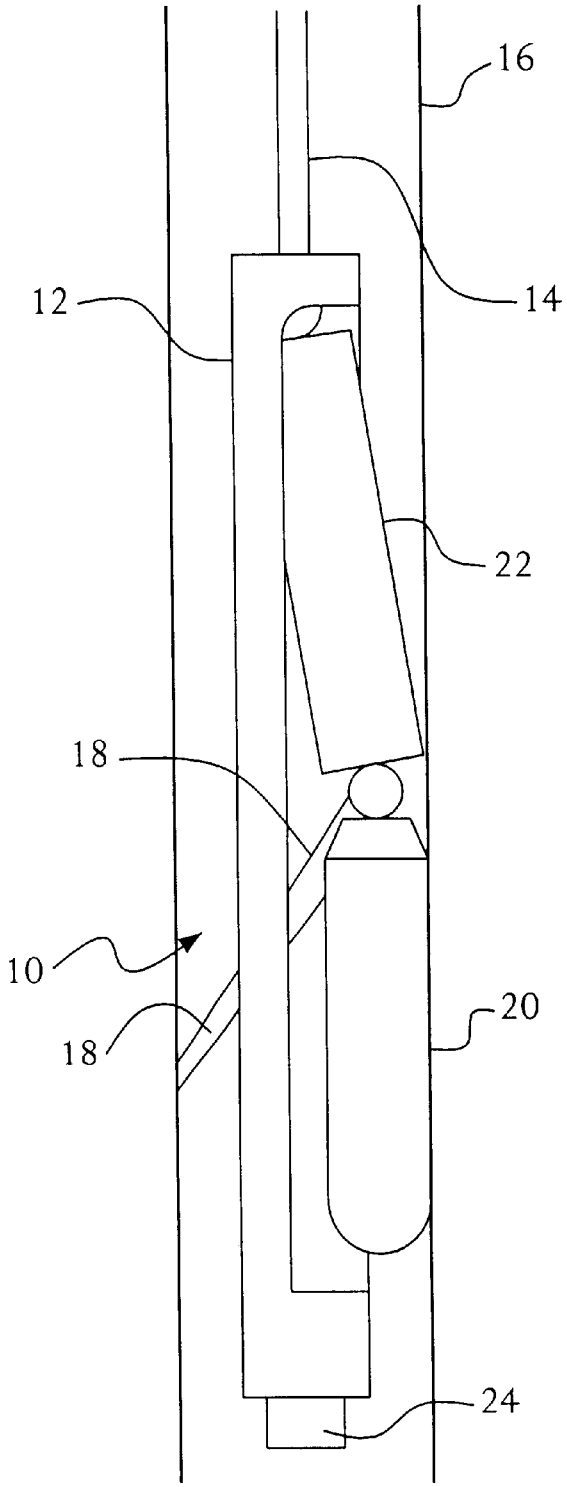
FIG. 1 illustrates diagrammatically a general arrangement showing a well-logging apparatus according to the present invention deployed in a well.

With reference now to FIG. 1, the well logging apparatus 10 comprises a carrier section 12 carried on a logging cable 14 inside a borehole 16. Within the carrier 12 a caliper arm 18 is deployed which enables a detector skid 20 to be moved by means of caliper drive link mechanism 22. At either end of carrier 12 a means 24 is provided to enable further measurement devices to be affixed to create a sonde stack. By the use of electronics within the skid, as described hereinafter the skid electronics may be connected to the sonde stack by a single electrical cable 241 (FIG. 2).

Figure 2:
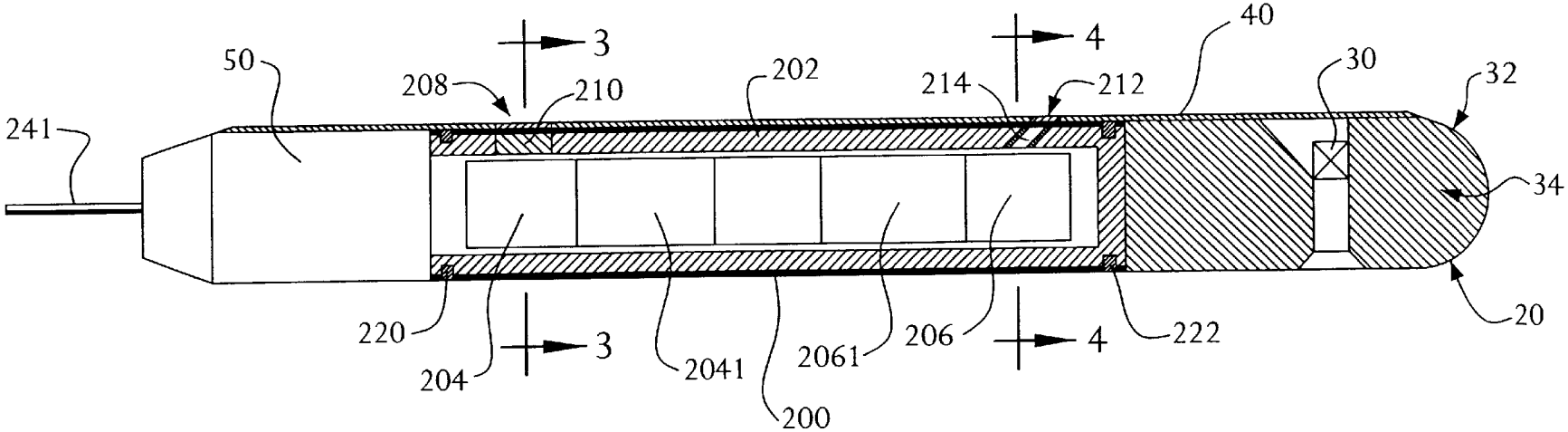
FIG. 2 shows the detection skid of the present invention diagrammatically in elongate cross-section.
Figure 4:
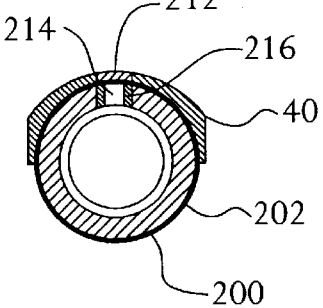
FIG. 4 shows the detector skid of FIG. 2 in cross-section along line B—B.
Figure 3:
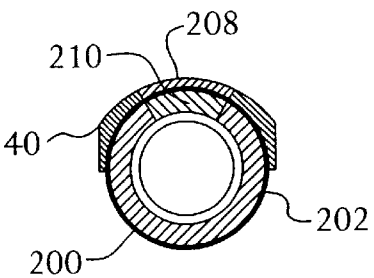
FIG. 3 shows the detector skid of FIG. 2 in cross-section along line A—A.

The detector skid 20 is shown in greater detail in FIGS. 2 to 4.

The skid comprises a continuous relatively thin walled stainless steel tube 200. Inside the stainless steel tube 200 is an inner tungsten radiation shield (collimator) 202 which provides further support for the tube 200 which is already strong because of its continuity.

The tube 200, because it is of relatively thin wall thickness, typically 1mm provides low energy gamma ray transparency. Two detectors are provided, a long spaced detector crystal 204 and a short spaced detector crystal 206 with associated photo multiplier tubes 2041 and 2061.

Adjacent to the long spaced detector 204 is a relatively large window 208 through the tungsten support 202 which window is preferably filled with a suitable filler material 210 such as aluminum or other light material to provide additional mechanism support for the stainless steel tube 200.

Adjacent to the short spaced detector crystal 206 is a relatively small window 212. The window comprises a hollow "tube" 214 through the tungsten support member 202. The hollow "tube" 214 is preferably lined with a tin lining 216. This lining preferable absorbs Tungsten X-rays which are stimulated by the incoming radiation and which would otherwise perturb the low energy gamma ray measurement.

The advantage of using the stainless steel tube is that since there are no apertures, welds or similar, in the thin tube, the maximum space is available for shielding and collimating the radiation beams.

The source 30 for the gamma rays is carried in an end portion 32 which comprises a relatively completely solid block 34.

A replaceable wear plate 40 overlays the skid.

An electronics section 50 is provided at the opposite end to the source 30.

The tungsten support member 202 and stainless steel tube 200 are sealed against each other by "O" ring seals 220, 222.

By employing a high level of integration, it is possible for the electronics to activate the detectors, process the results and communicate digitally with the surface computing and recording system are contained within the skid. This enables the cable and connector system to comprise, by means of compact electronics one wire, greatly simplifying the connectors and increasing its reliability.

The above features enable a device to be made with an overall diameter of 2¼" without sacrificing environmental or measurement performance, greatly enhancing the deployment and logging possibilities of the device.

What is claimed is:

1. A well logging device including a detector system having a long spaced detector crystal and a short spaced detector crystal mounted in a skid, said skid being provided with means for pressing said skid against the side of a borehole, said skid comprising an elongate tube having a continuous cylindrical wall of low energy gamma ray transparency, said tube being internally supported by an inner support means to provide support for said elongate tube over a major internal area of said elongate tube.

2. A well logging device as claimed in claim 1 in which said elongate tube comprises a stainless steel tube.

3. A well logging device as claimed in claim 1 in which said internal support means comprises an internal tungsten tube said elongate tube comprises a stainless steel tube.

4. A well logging device as claimed in claim 3 in which said internal tungsten tube is provided with a first relatively elongate window having length and width dimensions that are compatible with an adjacent said long space detector crystal.

5. A well logging device as claimed in claim 4 in which said relatively elongate window is provided with a filler capable of functioning as a reinforcing means.

6. A well logging device as claimed in claim 3 in which said internal support means is also provided with a shorter window having length and width dimensions generally compatible with an adjacent said short spaced detector crystal.

7. A well logging device as claimed in claim 6 in which the shorter window is not provided with a filler but is provided with a liner to absorb x-rays from the tungsten tube.

8. A well logging device of compact reduced diameter as claimed in claim 7 in which said liner is constructed from tin.

9. A well logging device as claimed in claim 8 wherein said means for pressing said skid against the side of a borehole is a pad provided with a skid electronic section adjacent to a reinforcing means and within the measurement skid.

10. A well logging device as claimed in claim 9 in which the elongate tube is a stainless steel tube and the reinforcing means is sealed against the stainless steel tube by a plurality of "o" ring seals adjacent to each end of the reinforcing means.

11. A well logging device as claimed in claim 10 in which the skid electronics are disposed in a through-wired carrier that is connected in a sonde stack by means of a single conductor cable.

12. A well logging device including a detector system having a short spaced detector crystal and a long spaced detector crystal mounted in a skid, said skid being provided with means for pressing said skid against the side of a borehole, said skid comprising an elongate tube of low energy gamma ray transparency, said tube being internally supported by an inner support means to provide support for said elongate tube over a major internal area of said elongate tube, wherein said internal support means comprises an internal tungsten tube, wherein said internal support means is also provided with a shorter window adjacent to said short spaced detector crystal, wherein the shorter window is not provided with a filler but is provided with a liner to absorb x-rays from the tungsten tube.

13. A well logging device having a short spaced detector crystal and a long spaced detector crystal including a detector system mounted in a skid, said skid being provided with means for pressing said skid against the side of a borehole, said skid comprising an elongate tube of low energy gamma ray transparency, said tube being internally supported by an inner support means to provide support for said elongate tube over a major internal area of said elongate tube, wherein said internal support means comprises an internal tungsten tube, wherein said internal support means is also provided with a shorter window adjacent to said short spaced detector crystal, wherein the shorter window is not provided with a filler but is provided with a liner to absorb x-rays from the tungsten tube, wherein said liner is constructed from tin.

* * * * *

UNITED STATES PATENT AND TRADEMARK OFFICE

CERTIFICATE OF CORRECTION

PATENT NO. : 6,308,561 B1
DATED : October 30, 2001
INVENTOR(S) : Samworth et al.

It is certified that error appears in the above-identified patent and that said Letters Patent is hereby corrected as shown below:

Column 3,
Line 53, please insert -- of compact reduced diameter -- after the word "device".

Column 4,
Line 16, please delete the phrase "of compact reduced diameter".
Line 49, please insert the phrase -- including a detector system -- after the word "device".
Lines 50 and 51, please delete the phrase "including a detector system".

Signed and Sealed this

Twenty-third Day of April, 2002

*Attest:*

*Attesting Officer*

JAMES E. ROGAN
*Director of the United States Patent and Trademark Office*